US006569001B2

(12) United States Patent
Rudolf et al.

(10) Patent No.: US 6,569,001 B2
(45) Date of Patent: May 27, 2003

(54) POWER TOOL HAVING A QUICK CLAMPING MECHANISM

(75) Inventors: Boris Rudolf, Stuttgart (DE); Gerhard Frenck, Fellbach (DE)

(73) Assignee: C. & E. Fein GmbH & Co., KG (DE)

( * ) Notice: Subject to any disclaimer, the term of this patent is extended or adjusted under 35 U.S.C. 154(b) by 7 days.

(21) Appl. No.: 09/931,706

(22) Filed: Aug. 16, 2001

(65) Prior Publication Data

US 2002/0028644 A1 Mar. 7, 2002

(30) Foreign Application Priority Data

Aug. 16, 2000 (DE) ..... 100 39 739

(51) Int. Cl.[7] ..... B24B 23/00

(52) U.S. Cl. ..... 451/344; 451/359; 451/363; 451/508; 451/510; 451/523

(58) Field of Search ..... 451/344, 359, 451/363, 508, 510, 523

(56) References Cited

U.S. PATENT DOCUMENTS 5,157,873 A * 10/1992 Rudolf et al. ..... 451/342

* cited by examiner

*Primary Examiner*—Joseph J. Hail, III
*Assistant Examiner*—Shantese L McDonald
(74) *Attorney, Agent, or Firm*—St. Onge Steward Johnston & Reens, LLC

(57) ABSTRACT

The invention relates to a power tool, in particular to an angle grinder, having a quick clamping device for fastening of a tool between a clamping flange and a counter flange. Such quick clamping devices are usually equipped with an actuation element, during the transfer of which from a clamping position into a release position the clamping is neutralized. In the quick clamping device according to the invention, the actuation element returns, on its own, and in a controlled way, when in the release position and, by accident, the motor of the power tool is turned on. For that purpose, an eccentric being mounted on the actuation element acts with its running surface onto a cam in such a way that it retains the eccentric due to the frictional force acting between the cam and the running surface. A rotation of the cam caused by starting the motor reduces the frictional force in such a way that the cam, being prestressed by a spring, moves, on its own, the actuation element out of the release position into the direction of the clamping position.

16 Claims, 7 Drawing Sheets

POWER TOOL HAVING A QUICK CLAMPING MECHANISM

BACKGROUND OF THE INVENTION

The invention relates to a power tool, in particular to an angle grinder, comprising a quick clamping device for fastening of a tool onto a spindle, comprising a clamping flange and a counter flange, between which the tool under the effect of an elastic force means is clamped, an actuation element being movable between a clamping position and a release position, wherein in the release position the clamping between the counter flange and the clamping flange against the effect of the elastic force means is neutralized, and a cam acting on the clamping flange which can, at least in the release position, be rotated by a motor of the power tool, and on which acts at least, when the actuation element is transferred from the clamping position in the release position, a running surface designed on the actuation element, wherein a movement of the actuation element is transferred into an axial shift of the clamping flange; and which, in the release position, when the motor is idle, holds the actuation element under the action of a frictional force acting between the cam and the running surface.

RELATED PRIOR ART

Such a power tool is known from EP 0 152 564 A2. This known power tool has a quick clamping device, by means of which disk-shaped tools, e.g. abrasive wheels or circular saw blades, can be exchanged quickly and comfortably. The quick clamping device comprises, for that purpose, a clamping flange constructed as a nut, and a counter flange, between which the disk-shaped tool is clamped. In this way, the clamping flange is screwed upon a clamping pin, which is attached for common rotation to a hollow spindle driven by the motor of the power tool, but movable in axial direction. The clamping pin is clamped, with respect to the hollow spindle, by means of a spring in such a way that the clamping pin is pulled toward the counter flange, due to the bracing effect of the clamping flange.

By transferring an actuation element, which is configured as a pivot lever, from a clamping position into a release position, the clamping between the clamping flange and the counter flange can be neutralized. To this end, a cylindrical socket is arranged on the pivot lever, said socket being screwed into the housing of the power tool. If the pivot lever is actuated, the socket is screwed further into the housing, until it, finally, acts upon the end of the clamping pin facing towards the socket and presses down the clamping pin, together with the clamping flange screwed thereon. In that way, the clamping between the clamping flange and the counter flange is neutralized, so that the clamping flange can be unscrewed from the clamping pin manually. After that, the tool can be exchanged against another tool.

In the operation of such power tools it has turned out that users sometimes switch on, carelessly or curiously, the motor of the power tool, although the pivot lever is still in the release position. It is true that also when the clamping flange is only loosely screwed upon the clamping pin, this cannot result in detaching the tool and, thus, in endangering the user. As, however, the dog is still in its declined position, it presses, with its bottom part, from the top onto the clamping pin, which now, after switching on the motor, rotates with high speed. Due to the relatively high forces, welding or deformation may occur in this case.

In the quick clamping device known from EP 0 152 564 A2, the friction conditions between the areas facing each other of the dog are selected in such a way that, when the motor is started, the friction force between the two areas is high enough to transfer the pivot lever into the clamping position. The pivot lever is, thus, if such an operating error occurs, returned into the clamping position.

It has turned out, however, that this return movement is relatively hard to monitor. On the one hand namely, by starting the motor, a relatively high torque is transmitted onto the pivot lever, as the adhesive friction between the two engaged parts, existing at the beginning, allows a high force transmission. Thus, the self-instructed return process starts with a very abrupt movement, which may result in accidents.

On the other hand, the friction conditions between the two engaged surfaces change after a while, as the force transmission is performed exactly by making use of the friction force and, thus, a wear of the surfaces is inevitable. The result is that also the force transmission and, in connection therewith, the kind of movement of the pivot lever changes after a while.

From EP 0 650 805 B1, another power tool is known, which is equipped with a similar quick clamping device. The actuation element is in this case, however, configured as a pivot lever, which is firmly connected with an eccentric. When the pivot lever is pivoted, the eccentric presses down a pressure head which is guided axially movable, until the eccentric rests on a thrust piece, into which the clamping flange is screwed via a threaded bolt. If the clamping lever is further pivoted, the pressure head finally presses down the thrust piece and, thus, also the clamping flange, against the action of cup springs.

In this known power tool, the pivot lever is connected via a shifter bar with a switch for starting the motor in such a way that the motor can be switched on only when the actuation element is in the clamping position. With this measure, it is prevented that, if the actuation element is in the release position, the lowered pressure head presses, with its bottom part, onto the thrust piece, which would rotate at high speed after starting the motor. Without such a measure, there would be welding or deformation between the pressure head and the thrust piece (or a friction plate fastened onto it), due to the relatively high forces. The mechanical connection between the actuation element and the switch for switching on the motor is, however, relatively complicated in design.

SUMMARY OF THE INVENTION

It is thus an object of the invention to disclose an improved power tool which overcomes the drawbacks of the prior art. It is a further object of the invention to provide a power tool that reliably avoids failures when the motor of the power tool is switched on erroneously. The power tool shall be nevertheless simple in design, while allowing a cost effective manufacturing.

With respect to such a power tool as mentioned at the outset, this object is achieved by mating the cam and the running surface in such a way that, in the release position, a rotation of the cam caused by starting the motor reduces the frictional force between the cam and the running surface in such a way that the cam, which was prestressed by elastic force means, moves the actuation element from the release position into the direction of the clamping position on its own.

The solution principle underlying the invention is, consequently, distinguished by the fact that, for restoring the actuation element in its clamping position, not a torque generated by the motor is used, but, rather, the pressure exerted by the elastic force means via the cam onto the actuation element is used. As long as the cam rests, however, the adhesive friction force acting between the cam and the running surface keeps the actuation element in the release position. Only if the cam, when the motor is started, is set into rotation, the adhesive friction transitions into a distinctively smaller sliding friction, which is, then, not sufficient any more to keep the actuation element in the release position. The motor causes, thus, merely a modification of the friction conditions between the cam and the running surface; a force transmission from the motor to the actuation element, however,—at least in a significant amount—does not take place.

In comparison to the clamping device of EP 0 152 564 A2 mentioned at the outset, this principle has the decisive advantage that the speed of the actuation element, when being returned, is practically not dependent any more on the motor speed, but only depends on constructively determinable, mostly unchangeable parameters.

These parameters are, in particular, the pressure force caused by the elastic force means, the moment of inertia of the actuation element, the direction in which the cam acts on the actuation element via the running surface, and, of course, the friction conditions between the cam and the running surface. The latter depend, on their part, on the type of the tools used as well as on their surface quality.

In this regard, by the way, a clamping flange and a counter flange shall be regarded as any component suitable to clamp a tool onto a shaft. The clamping flange can be, in particular, a common nut, which is screwed onto the shaft.

In this regard, the terms clamping position and release position are not to be understood in a limiting sense, designating an exactly defined position. The clamping position shall rather be any position, i.e. also a greater position area of the actuation element, in which at least a partial clamping of the clamping flange and the counter flange is obtained. Correspondingly, all positions are designated as release position, in which there is no clamping between the clamping flange and the counter flange. So, if a movement of the actuation element from the release position in direction to the clamping position is the subject, this means, finally, that the actuation element is moved so far until clamping takes place at least partially. This results, on the other hand, in a relief of the components of the quick clamping device, so that additional forces generated by the motor can practically not result in damage any more.

A cam shall be any component, which engages, for the purpose of force transmission, a surface provided on another component, here called running surface. A special shape is not to be implied with the term cam. The running surface itself can be plain, but also be curved optionally, wherein the curves can also be considered as inclinations of a running surface unwound.

In this regard, it is particularly preferred, if the running surface has at least two sections of different inclinations.

This has the advantage that, by variation of the inclination of the running surface, the movement behavior of the actuation element, when returning on its own into the clamping position, can be influenced within certain limits by construction. Namely, the inclination influences the direction in which the cam acts upon the actuation element via the running surface. For instance, a setting of the running surface inclination is possible, in which the actuation element is transferred from the release position into the clamping position at approximately constant speed.

In a preferred improvement of this embodiment, the inclination of the running surface is smaller in the release position of the actuation element than the inclination of the running surface in the clamping position.

Thus, a small force transmission onto the actuation element at the beginning can be obtained, so that the return movement into the clamping position can be initiated slowly. Thereafter, the inclination of the running surface increases, so that the actuation element more accelerates. This can e.g. be advantageous, if the actuation element can be locked in the clamping position. The speed of the actuation element may then be sufficient to overcome the detent resistance.

In another advantageous embodiment of the invention, the running surface has at least two sections of different surface qualities.

This has the advantage that, in that way, also after the return movement has started, the friction conditions can be influenced. E.g. the running surface can be provided with a roughened section, which increases the sliding friction in such a way that a self-acting return pivoting of the actuation element is retarded, or at least a further acceleration is counterbalanced. The surface quality can also be modified by coating.

In a particularly preferred embodiment of the invention, the running surface is the circumferential unroll area of an eccentric arranged on the actuation element, mounted pivotably about a pivot axis.

This has the advantage that the running surface is so-to-speak rolled around the eccentric and, thus, has an essentially smaller "space requirement" than a plain surface, as it may be e.g. constructed on an actuation element constructed as a slider. For example, the actuation element can have a pivot knob arranged laterally on the eccentric, by which the eccentric can be pivoted around its axis.

In a preferred improvement of this embodiment, the actuation element, however, comprises a pivot lever, which is fastened on the eccentric and is pivotable about the pivot axis of the eccentric.

The use of a pivot lever has the advantage that much higher torques can be applied than possible with a rotation knob, for instance. Moreover, by the sweeping pivot movement of the pivot lever in the self-acting return movement from the release position into the clamping position, it is clearly shown to the user that he has omitted to bring the pivot lever, before actuating the power tool, into the clamping position. The fixation of the pivot lever on the eccentric can also be performed via a free running. When the actuation element is in the release position, only the eccentric moves back to the clamping position, but not the pivot lever, when the motor is started.

In another advantageous improvement of this embodiment, the eccentricity of the eccentric is between 1% and 20% of the largest diameter of the eccentric.

It has been found that with such a selected eccentricity of the eccentric a particularly reliable force transmission according to the principle of the invention is possible.

In another preferred embodiment of the invention, the eccentric is arranged laterally displaced with respect to the pivot axis of the cam, into the direction in which the pivot axis of the eccentric extends.

Such a transverse displacement results in that, when starting the motor in the release position, the rotating cam transmits an additional torque onto the eccentric, which is not due to the elastic force means, but to the rotation of the cam as such. Whether this additional torque supports or counteracts the torque produced by the elastic force means, depends on the side to which the eccentric is arranged, displaced, in the direction of the eccentric pivot axis. Preferably, the displacement is selected so that the torque produced by the elastic force means is supported for reaching an additional acceleration of the actuation element.

In a further preferred embodiment of the invention, the surfaces of the cam and of the running surface have a Vickers hardness of more than 54, preferably about 64, and a surface roughness $R_z$ of 0.2 $\mu$m to 8 $\mu$m.

In that manner, due to the great hardness, a sufficient wear resistance is provided, so that the friction conditions between the cam and the running surface, which are decisive for returning the actuation element, remain constant in the course of time. On the other hand, a roughness selected in such a way provides for a sufficient adhesive friction force between the cam and the running surface, so that the actuation element, in the release position, when the motor is idle, can be held by the cam. For example, such a surface quality can be reached by hardening and grinding, or by tumbling steel parts (if necessary, sintered).

In another advantageous embodiment of the invention, the surfaces of the cam and of the running surface consist of a porous sinter material, the pores of which near to the surface are filled with a lubricant.

By this measure known per se, an emergency running lubrication between the cam and the running surface is guaranteed. When the surfaces are worn, namely, the pores open gradually, thus releasing the lubricant contained therein.

In another preferred embodiment of the invention, the spindle being driven by the motor is constructed as a hollow spindle. The cam acts on the clamping flange via a thrust piece, to which the clamping flange is fastened detachably, the thrust piece being arranged movably in axial direction in the hollow spindle by the cam engaging the thrust piece against the effect of the elastic force means.

By this measure known per se, a very reliable quick clamping device can be realized in a simple way. The cam can be part of the thrust piece or can be firmly connected thereto, so that each movement of the actuation element is transmitted directly onto the thrust piece and, thus, onto the clamping flange fastened thereon. In this case, however, a small distance should be kept, at least in the clamping position, between the running surface and the cam, so that, during operation of the power tool, there will not be permanent friction between the rotating cam and the running surface of the actuation element.

In an advantageous improvement of this embodiment, the cam is, however, not directly connected to the thrust piece. The cam is, rather, part of a pressure head, which is mounted rotatably in a sleeve and, when the actuation element is transferred into the release position against the effect of said elastic pressing means, which presses the cam of the pressure head against the running surface of the actuation element, the pressure head is moved in such a way in the direction of the thrust piece that the pressure head comes at least indirectly in friction contact with the thrust piece.

This has the advantage that, on the one hand, the cam is always in touch with the running surface of the actuation element. This gives a better feeling when operating the actuation element than if it would suddenly be placed with its running surface on the cam. The friction contact between the pressure head and the thrust piece facilitates in particular the exchange of the tool, since also the hollow spindle being connected to the thrust piece for common rotation is blocked against rotation due to the friction contact. In order to enlarge the friction between the pressure head and the thrust piece, the latter can be, on its end, connected to a friction plate. This friction plate has a surface with a sufficiently high coefficient of friction and can be, should it once be worn, exchanged relatively easily against a substitute plate.

In another advantageous embodiment of the invention, an elastic return means acts onto the actuation element, which, independently of a rotation of the cam exerts a force onto the actuation element, which supports a movement of the actuation element from the release position into the direction of the clamping position.

By means of such an additional return means, it is reached that the actuation element also occupies a clamping position definable by a stop, when the actuation element is in an interposition between clamping position and release position. This embodiment makes also sense, in particular, in such embodiments, in which no pressure head admitted by elastic force means acts upon the actuation element, as was described above.

It is to be understood that the features mentioned above and those yet to be explained below can be used not only in the respective combinations indicated, but also in other combinations or in isolation, without leaving the scope of the present invention.

BRIEF DESCRIPTION OF THE DRAWINGS

Preferred embodiments of the invention are explained in the following in more detail with reference to the drawings. In the drawings.

DETAILED DESCRIPTION OF THE PREFERRED EMBODIMENTS

Figure 1:
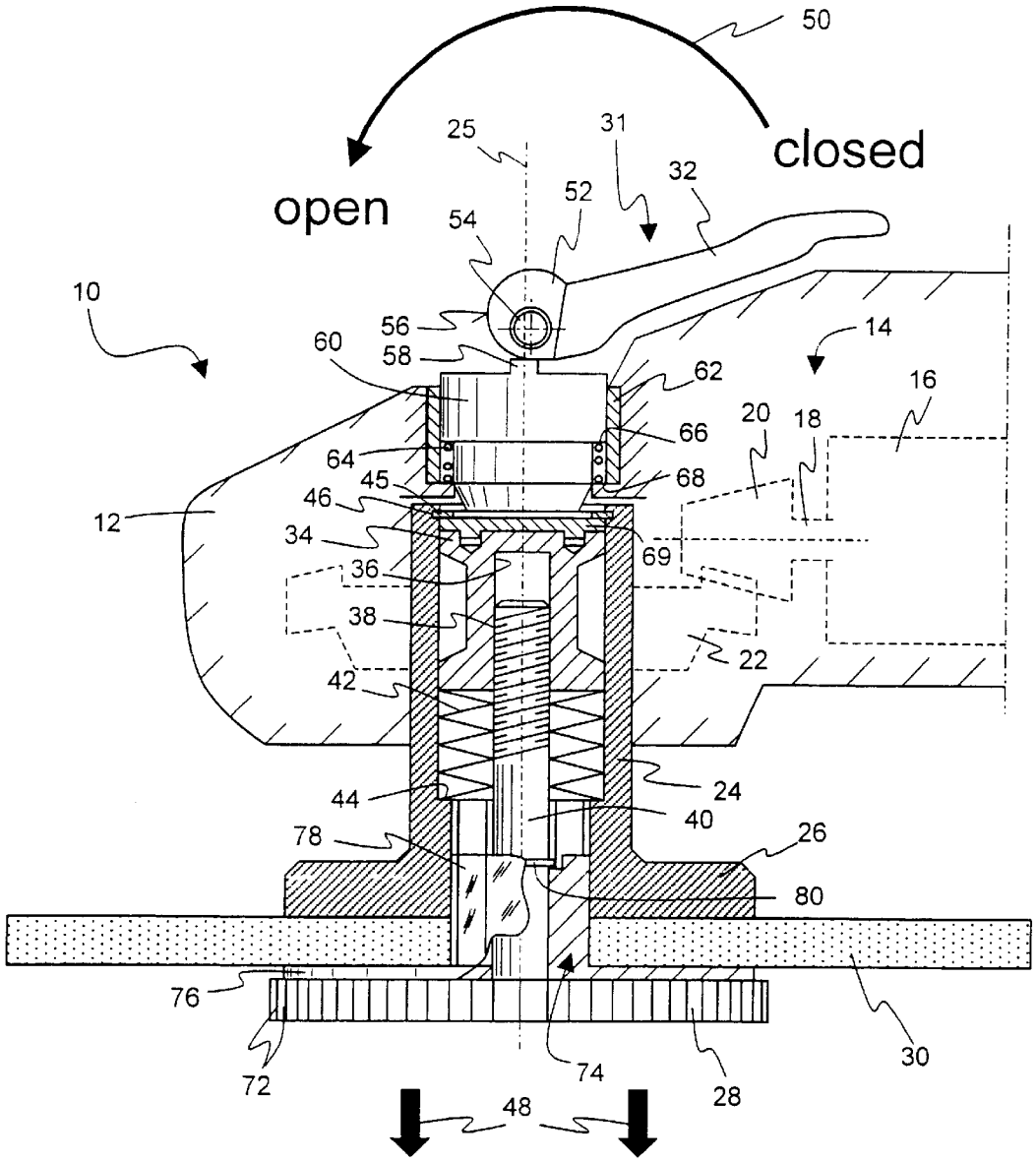
FIG. 1 shows a simplified longitudinal section through a power tool of the invention in the area of its gear head, wherein an actuation element for the quick clamping device is in the clamping position, in which a tool is clamped between a clamping flange and a counter flange.

In FIG. 1, a first embodiment of a power tool according to the invention embodied as an angle grinder is designated in its entirety with 10. Within a casing 12 of power tool 10 there is a motor-/gear unit 14, which is, for the sake of clarity, represented in a dashed way. Motor-/gear unit 14 comprises an electric motor 16, the motor shaft 18 of which carries a pinion 20 for a bevel gear unit. A drive gear 22 of the bevel gear unit is rigidly connected to a hollow spindle 24, which is mounted in ball bearings—not shown in FIG. 1—rotatably about a rotation axis 25. On an end of hollow spindle 24 protruding outwardly out of casing 12, a counter flange 26 is arranged to which a clamping flange 28 for clamping a tool 30 is assigned. Tool 30 is a grinding disk or a cutting disk in the embodiment shown. In order to allow a manual exchange of tool 30, a quick clamping device is provided, which comprises, among other things, counter flange 26, clamping flange 28 and an actuation element 31 with a pivot lever 32. By actuating actuation element 31, a bracing acting between counter flange 26 and clamping flange 28 can be overcome.

For that purpose, the quick clamping device has a thrust piece 34 being coaxially arranged in hollow spindle 24. Thrust piece 34 has approximately the shape of a cup and is held, by means of guidings, which are not shown in detail, movably in axial direction for common rotation with hollow spindle 24. On its inner side, thrust piece 34 is provided with an inside thread 36, into which a clamping pin 40 having an outer thread 38 can be screwed. Clamping pin 40, on its part, is firmly connected to clamping flange 28, or is integral therewith.

The bracing creating a tight seat between counter flange 26 and clamping flange 28 is effected by a cup spring set 42 only schematically indicated, which is supported, on one side, by a step 44 rotating in hollow spindle 24. On the opposite side, cup spring set 42 is supported by the bottom side of thrust piece 34. As the upper side of thrust piece 34 gets in contact with a retaining ring 45, which is inserted in a groove 46 rotating in hollow spindle 24, the unit being formed by thrust piece 34, clamping pin 40 and clamping flange 28 can be moved only against the effect of cup spring set 42 downwardly into the direction of the arrows designated with 48.

Figure 2:
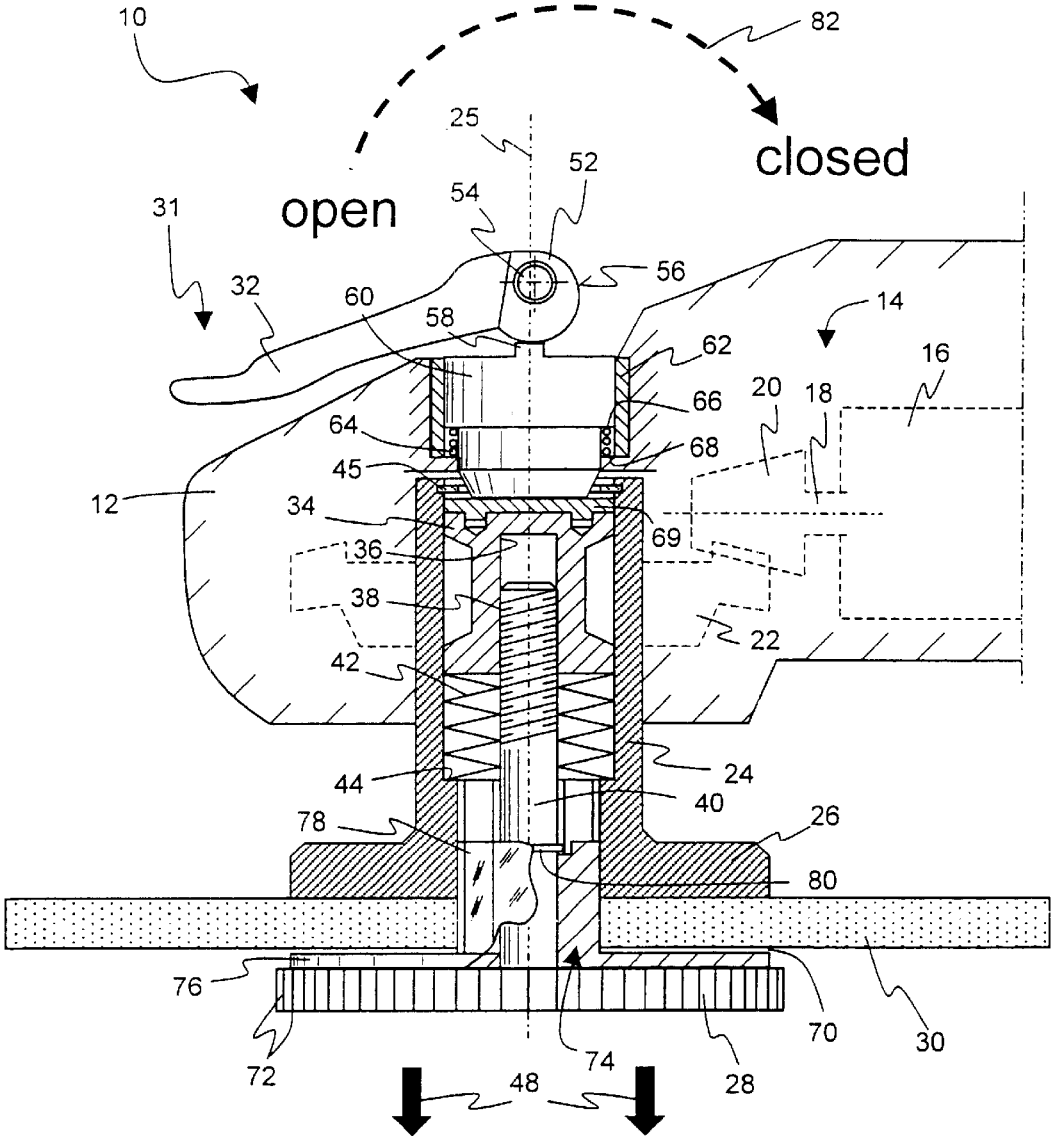
FIG. 2 shows the power tool of FIG. 1, in which the actuation element was transferred into the release position, so that the bracing between the clamping flange and the counter flange is counterbalanced.

A compensation of the bracing caused by cup spring set 42 is only possible by means of actuation element 31, by transferring pivot lever 32 arranged therewith, in the direction represented by an arrow 50, from the clamping position shown in FIG. 1 into a release position shown in FIG. 2.

Pivot lever 32 is fixedly connected to an eccentric 52, which is mounted onto a shaft 53 pivotably about a pivot axis 54. A running surface 56 forming the unroll area of eccentric 52 acts on a cam 58, which is configured integral with a pressure head 60. Pressure head 60 is seated rotatably about the rotation axis 25 in a self-lubricating bearing sleeve 62 axially movable. By means of a helical spring 64, which is held between a ring shoulder 66 of pressure head 60 and a projection 68 of casing 12, pressure head 60 is pressed against running surface 56 of eccentric 52, so that pressure head 60 is always in contact with actuation element 31.

Figure 3:
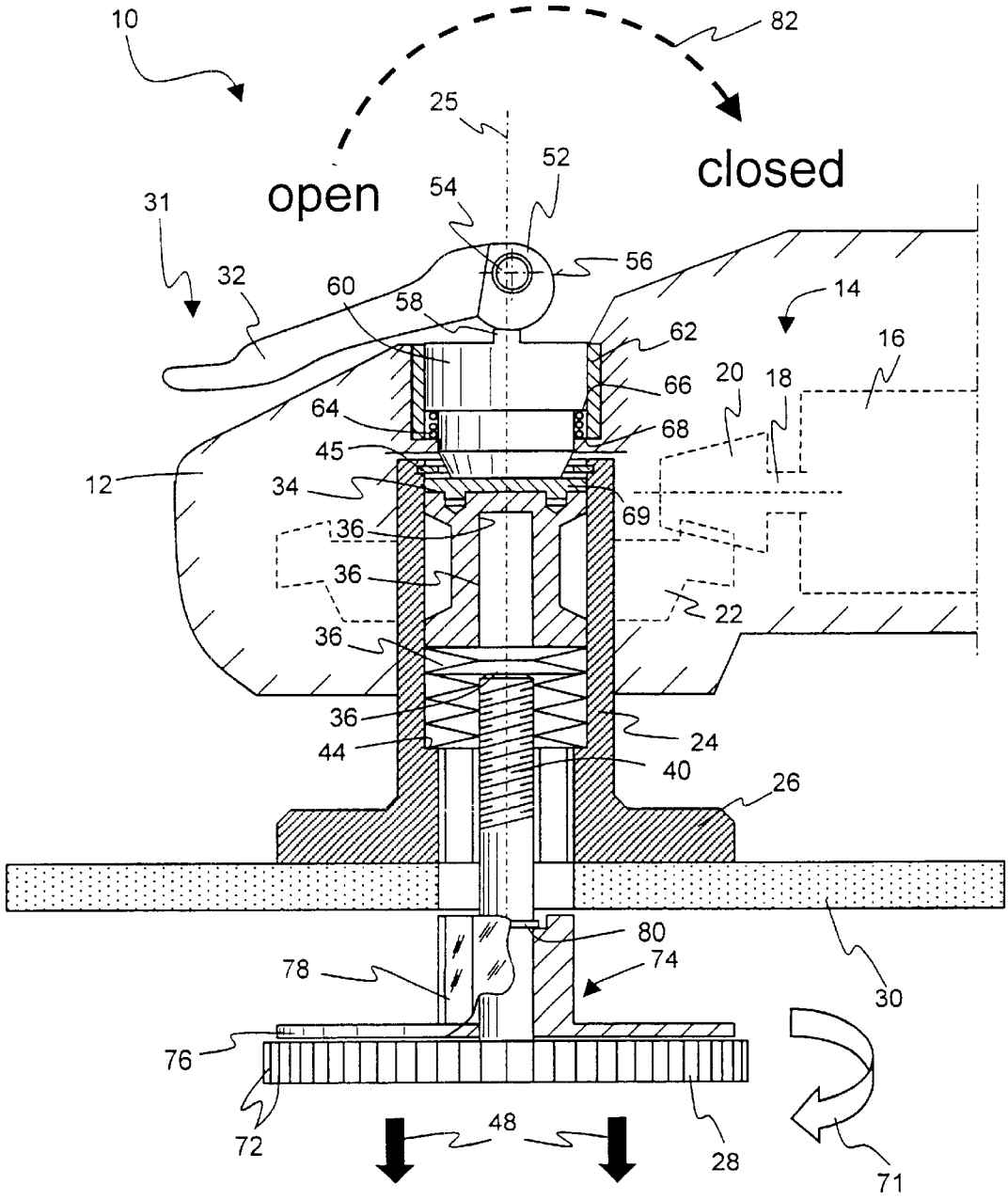
FIG. 3 shows the power tool of FIGS. 1 and 2, in which in the release position of the actuation element the clamping flange is completely unscrewed.

The function of the quick clamping device of the invention is now explained in more detail by means of FIG. 2 and 3.

If pivot lever 32 is moved into the direction of arrow 50, due to the eccentricity, eccentric 52 presses down cam 58, via its running surface 56. By this measure, pressure head 60 moves down altogether, against the effect of helical spring 64. Approximately after half of the pivot way of actuation element 31, the conically shaped bottom end of pressure head 60 gets in touch with a friction plate 69, which is fixed to the hollow spindle on the axial upper side of thrust piece 34 for common rotation therewith.

If pivot lever 32 is further pivoted into the release position, the descending movement of pressure head 60 is continued, which now presses thrust piece 34 against the effect of cup spring set 42 down into the direction of the arrows 48. Clamping flange 28 being screwed into thrust piece 34 is moved down by the same amount. Thus, between clamping flange 28 and tool 30, a small gap 70 is created, which shows that the bracing between counter flange 26 and clamping flange 28 is now compensated. This state is shown in FIG. 2.

In this unstressed state, no significant friction forces act any more between tool 30 and clamping flange 28. Clamping flange 28 can, thus, be unscrewed by hand in this position of thrust piece 34, as indicated in FIG. 3 by an arrow 71. In order to facilitate unscrewing, the clamping flange is provided with a circumferential knurl 72.

In the embodiment shown in FIGS. 1 to 3, clamping flange 28 does not rest directly on tool 30. Rather, on the unit formed by clamping flange 28 and clamping pin 40, an intermediate flange 74 is located rotatably, which consists of a thin disk 76 and of a dog 78 protruding from the center of disk 76. A cylindrical bore runs through the center of disk 76 and dog 78, through which clamping pin 40 is led. On its outer sides, dog 78 has the shape of a regular polygonal. This polygonal shape has its corresponding part in the section of hollow spindle 24 beneath cup spring set 42, which has also, at its inner part, the form of a polygonal. Intermediate flange 74 with its dog 78 can thus be entered into this section of hollow spindle 24, to reach a positive fit between hollow spindle 24 and intermediate flange 74. A mutual rotation of hollow spindle 24 and intermediate flange 74 is then, even in the release position, not possible any more.

In the clamping position of actuation element 31, tool 30 is clamped between counter flange 26 and clamping flange 28. In order to guarantee a positive engagement between clamping flange 28 and counter flange 26 in the clamping position and, thus, to prevent detaching of clamping flange 28 in all operating conditions, the surfaces of clamping flange 28 and intermediate flange 76 facing each other are additionally provided with front gear teeth or the like. Thus, a continuous positive fit engagement between clamping flange 28 and hollow spindle 24 is reached. Consequently, it is not possible that clamping flange 28 together with clamping pin 40 during use of the power tool detaches on its own from thrust piece 34 by rotation. It is, thus, sufficient, after exchange of the tool, to tighten clamping flange 28 only slightly, until clamping flange 28 gets into touch with intermediate flange 76, as, after bracing, clamping flange 28 is fixed in any case, and the bracing effected by cup spring set 42 is practically independent of how far clamping pin 40 is screwed into thrust piece 34.

As clamping flange 28, after compensating the bracing towards intermediate flange 76, can be easily rotated, clamping pin 40 can be screwed out of thrust piece 34, even if intermediate flange 74 is still held with its dog 78 nonrotatably with respect to hollow spindle 24. A retaining ring 80 applied onto clamping pin 40 carries along intermediate flange 74, when clamping pin 40 is unscrewed, until intermediate flange 74 reaches the position shown in FIG. 3. Clamping flange 28 can now, together with intermediate flange 74 and clamping pin 40, be completely pulled out into the direction of arrows 48, whereby tool 30 is taken off from counterflange 26 and can be exchanged against a new tool. The assembly is performed the other way round.

In the quick clamping device of the invention, eccentric 52 acts together with cam 58 in such a way that, if actuation element 31 is in the release position shown in FIG. 2 and 3, actuation element 31 is automatically returned again into the direction of the clamping position, as soon as the motor 16 of power tool 10 is started. As in the release position pressure head 60 is pressed onto thrust piece 34, if the motor is started by mistake, a movement of hollow spindle 24 is transmitted via an existing friction contact onto thrust piece 34 being arranged thereon and, thus, onto pressure head 60 and cam 58 being arranged thereon. The rotation of pressure head 60 caused thereby causes a transition of the adhesive friction, which acts between cam 58 and running surface 56 arranged on eccentric 52, into sliding friction, which is much smaller. While the adhesive friction acting when pressure head 60 was standing still, kept actuation element 31 in the release position, now the torque, which pressure head 60, being under pressure of cup spring set 42, applies via cam 58 onto eccentric 52, prevails over the torque acting into the other direction, which is caused by the sliding friction. Eccentric 52 begins, thus, together with pivot lever 32, to move back into the direction indicated by dashed arrow 82 to the clamping position.

The processes acting between cam 58 and eccentric 52 are explained in the following by means of FIG. 4 and 5.

Figure 4:
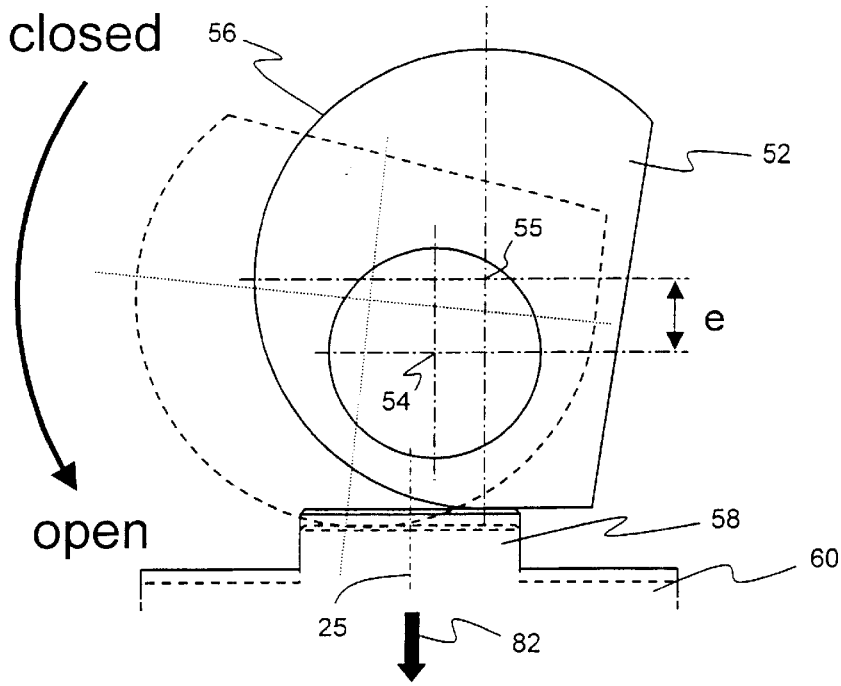
FIG. 4 shows a schematic longitudinal section through an eccentric with a cam acting thereon while the actuation element is transmitted into the release position.

FIG. 4 shows in full lines eccentric 52 and cam 58 constructed on pressure head 60 in the clamping position shown in FIG. 1. Pivot lever 32 is not shown for the sake of clarity. Running surface 56 of eccentric 52 describes in the embodiment shown in FIG. 4 the form of an arc. The eccentricity designated as e, i.e. the vertical distance between the center point 55 of the arc and pivot axis 54 of eccentric 52 in the clamping position, determines the measure by which in a rotation of eccentric 52 cam 58 is pressed down. In a rotation of eccentric 52 about 180°, this measure is 2*e*.

Eccentric 52 is represented in dashes in FIG. 4 in a rotation of about 45° into the direction of the release position. In this process, it can be seen how running surface 56 of eccentric 52 moves to the bottom and transmits cam 58 into the position shown in dashes. Pressure head 60 moves, thus, into the direction indicated by arrow 82.

Figure 5:
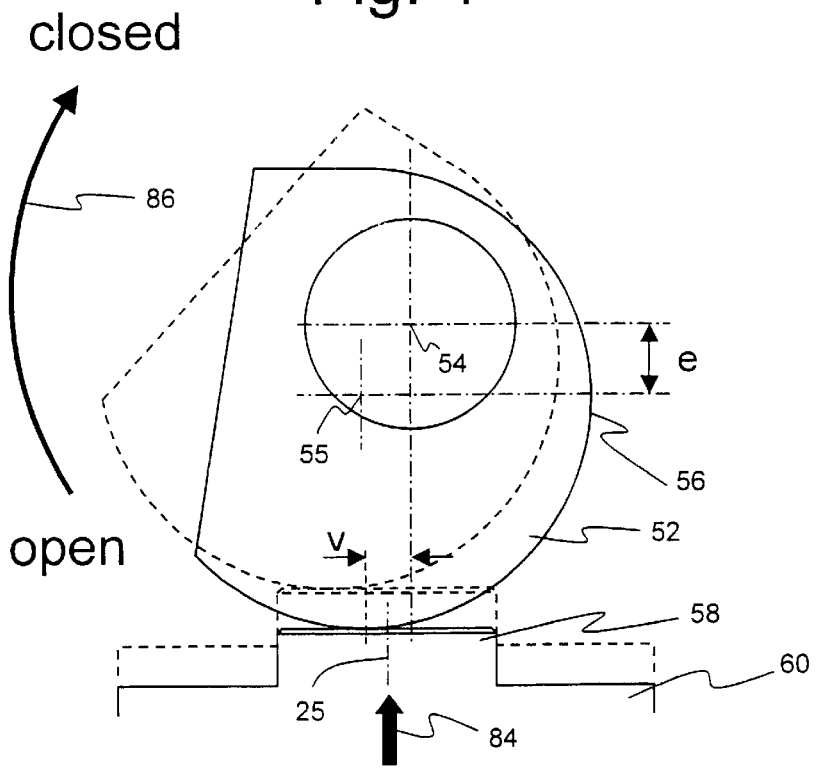
FIG. 5 shows a representation corresponding to FIG. 4, in which the actuation element is returned from the release position into the clamping position.

FIG. 5 shows in full lines eccentric 52 in the release position. As pressure head 60 is pressed to the top by cup spring set 42 into the direction indicated by arrow 84, a torque acts upon eccentric 52, which strives to transmit eccentric 52 into the clamping position in direction of arrow 86. This torque comes into being because cam 58 exerts a force onto eccentric 52, the force not being directed centrally to the pivot axis of eccentric 52. Rather, a mismatch or offset v exists between the contact line, along which eccentric 52 and cam 58 get in touch, and pivot axis 54 of the eccentric. From this mismatch v, a lever arm results, which leads to the torque mentioned. In the embodiment described above, the arc diameter is 12.6 mm, the eccentricity e 1.2 mm and the mismatch v 0.2 mm.

As long as pressure head 60 with cam 58 rests, the adhesive friction acting between running surface 56 of eccentric 52 and the upper side of cam 58 causes eccentric 52 and, thus, whole actuation element 31 to remain in its release position, in spite of the acting torque.

If, now, however, by operating the motor, pressure head 60 is, rotated together with cam 58, the adhesive friction between running surface 56 and cam 58 transitions into sliding friction. If cam 58 and running surface 56 are manufactured of hardened polished steel, the sliding friction is smaller than the adhesive friction by approximately one dimension. The friction is now not sufficient any more to counterbalance the torque exerted by the pressure head, so that eccentric 52 moves back into the direction of the clamping position via the direction indicated by arrow 86.

An eccentric 52 led back by approximately 60° is indicated in FIG. 5 in dashes. It can here be seen that pressure head 60 now moving to the top in the direction of arrow 84, still exerts a torque onto eccentric 52 via cam 58 configured on pressure head 60, so that actuation element 31 increasingly accelerates, until it is, finally, transferred into the clamping position shown in FIG. 4 (or into a position shortly before).

Figure 6:
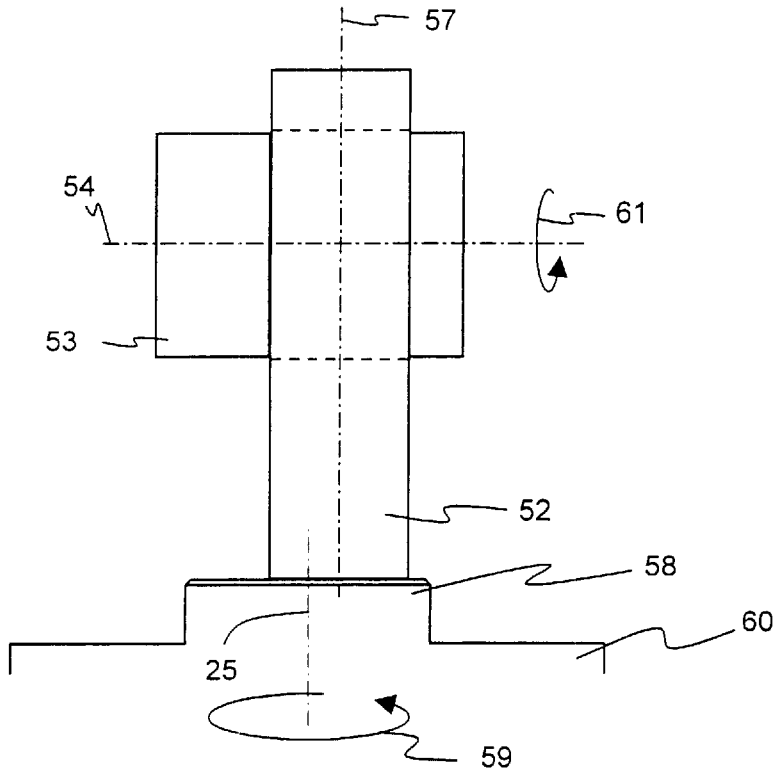
FIG. 6 shows a rear view onto the eccentric of FIG. 5, in which can be seen that the eccentric is arranged, in the direction of the eccentric pivot axis, displaced to the cam.

FIG. 6 shows a rear view onto eccentric 52, wherein it can be seen that eccentric 52 is arranged displaced to cam 58 in the direction of pivot axis 54 of the eccentric. The size of this mismatch or offset equals the distance between a center plane 57 of eccentric 52 and of pivot axis 25 of cam 58. Due to this displacement, the contact line between eccentric 52 and cam 58 is not arranged symmetrically any more with respect to pivot axis 25 of cam 58. When cam 58 is rotated, an additional torque is exerted onto eccentric 52, the direction of which depends on whether cam 58 rotates about its pivot axis 25 clockwise or anticlockwise. In the embodiment shown, cam 58 rotates in the direction indicated by arrow 59, thus causing eccentric 52 to move back about its longitudinal axis 54 in the direction of arrow 61 into its clamping position.

A similar effect is caused, by the way, when eccentric 52 is slightly conically shaped with respect to the direction of pivot axis 54. It is, thus, reached that the contact line between eccentric 52 and cam 58, which is shortened in this case almost to a contact point, is not arranged symmetrically any more with respect to pivot axis 25 of cam 58. The conical form of eccentric 52 can, in this regard, adopt values of approximately 0.1 to 1°, preferably of approximately 0.3°.

Preferably, however, both eccentric 52 and pressure head 60 with cam 58 consist of sintered tumbled steel parts, the Vickers hardness of which is in the range of about 64, and the surface roughness $R_z$ of approximately 2 $\mu$m. This has the advantage, as already mentioned above, that in this manner a particularly high difference between the adhesive friction and the sliding friction is created. Apart from that, due to the high hardness, wear is low, so that the friction conditions between cam 58 and running surface 56, which are decisive for the leading back of actuation element 31, and also the lift generated while pivoting pivot lever 32 remain constant in the course of time. For such steel surfaces the adhesive friction force is approximately 300 N and the sliding friction force approximately 40 N, if cup spring set 42 generates a pressing force of approximately 3000 N.

In order to be able to influence the torque acting onto eccentric 52 while being pivoted back into the clamping position, an eccentric can be used, the running surface of which has no constant inclination, instead of an eccentric with arc-shaped running surface.

Figure 7:
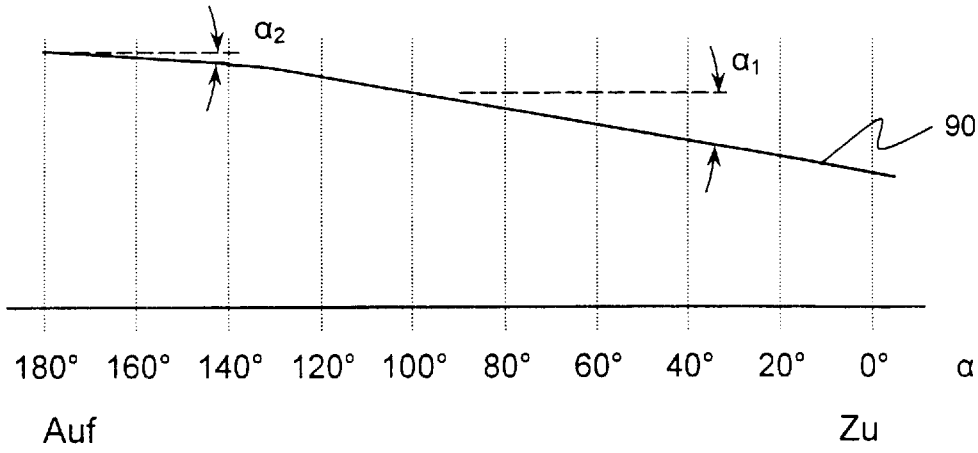
FIG. 7 shows an unrolling of an eccentric unroll area.

In FIG. 7, an unroll area of an eccentric modified in such a way over the pivot angle $\alpha$ is applied. It can be seen in this procedure that inclination $\alpha_2$ of the unroll area is smaller in large pivoting angles (release position) than inclination $\alpha_1$ of the unroll area in smaller pivoting angles (clamping position). This configuration of the unroll area causes actuation element 31 to leave the release position slowly first and then to accelerate faster after the motor is started. If desired, the final speed can be that high that actuation element 31 finally ends in an end position by overcoming a locking resistance, actuation element 31 being immersed in a recess in casing 12 of power tool 10. With higher locking resistances, this may, however, not be useful, as this would possibly require such a high acceleration of actuation element 31 that an endangering of the user in the pivoting process cannot be excluded.

The speed in the automatic return pivoting of actuation element 31 may also be influenced by modifying the surface quality of running surface 56. It can, for instance, be provided that the running surface is roughened such that between a pivot angle of 0° and 60° (seen from the clamping position, see FIG. 3) that, due to the adhesive friction being larger between this pivot angle, the automatic return pivot movement of actuation element 31 is retarded or, at least, a further acceleration is opposed to.

In the embodiment shown in FIGS. 1 to 3, cam 58 is configured on pressure head 60, which, not before actuation element 31 is pivoted, acts on thrust piece 34. Alternatively, eccentric 52 may be configured to act directly onto thrust piece 34. Thrust piece 34 has to be configured such that it projects out of the top of hollow spindle 24. On thrust piece 34, a cam 58 can additionally be configured. But cam 58 can be omitted in the sense that the whole thrust piece 34 and/or pressure head 60 are considered to be a cam, both in this example and in the embodiment mentioned above.

Figure 8:
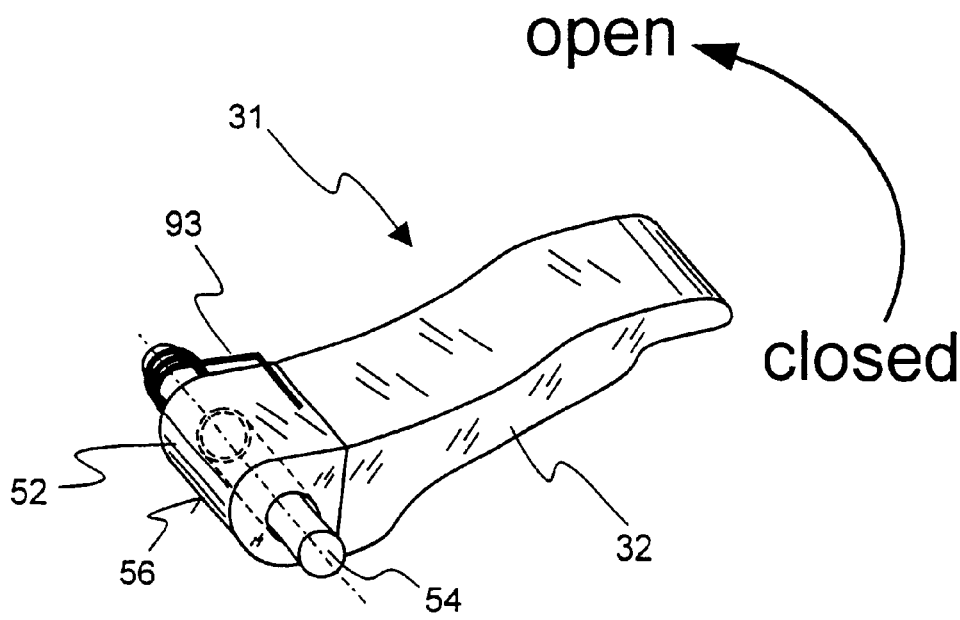
FIG. 8 shows an actuation element suitable for the power tool of the invention, in a perspective view.

In order to prevent for this alternative embodiment even in the clamping position of actuation element 31, a steady friction between thrust piece 34 and running surface 56 being configured on eccentric 52, a small gap should remain in the clamping position between eccentric 52 and thrust piece 34. In order to replace the effect of helical spring 64, a restoring spring 92 acting on actuation element 31 may be provided, as shown in FIG. 8. Restoring spring 92 prestresses actuation element 31 already in its clamping position with a small spring force and provides for the necessary distance to thrust piece 34.

Finally, it is also possible to use a rotation lever instead of a pivot lever, as described in EP 0 152 564 A2 mentioned at the outset. The surfaces of the pivot lever and of the thrust piece (and/or of a thrust piece acting) touching each other in the release position, and the pitch of the thread by which the pivot lever is screw-connected with the casing, are then to be designed such that, if the motor is activated, the pivot lever is just not set in motion by a force that was transmitted by friction contact onto the pivot lever from the thrust piece. Rather, the parameters mentioned are to be determined such that the friction at the contact surface decreases, when the thrust piece rotates, so that the pivot lever is turned out of the thread exclusively under the effect of the elastic force means and, thus, is led back into its clamping position. In that way, the pivot lever can be led back into the clamping position in a much more controlled way, as if it was driven directly via friction contact by a motor.

Figure 9A:
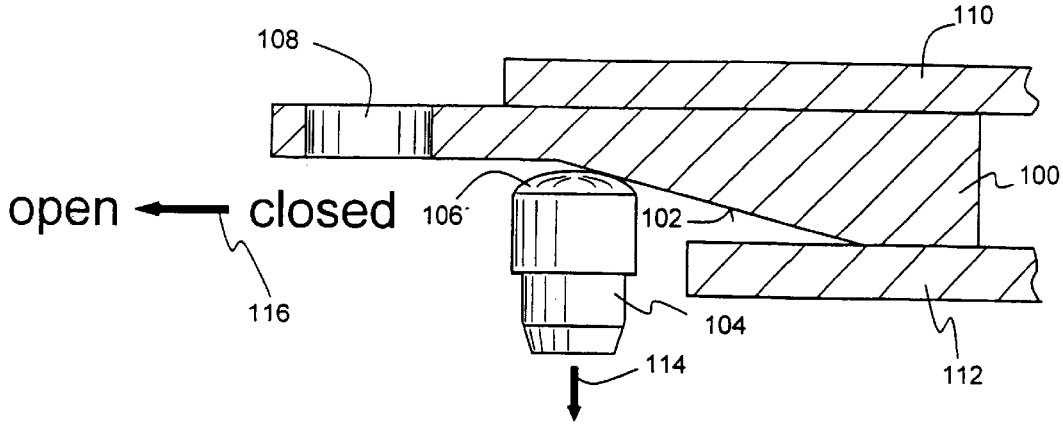
FIG. 9*a* shows a highly simplified longitudinal section through another embodiment of an actuation element suitable for the invention, which is in the clamping position.
Figure 9B:
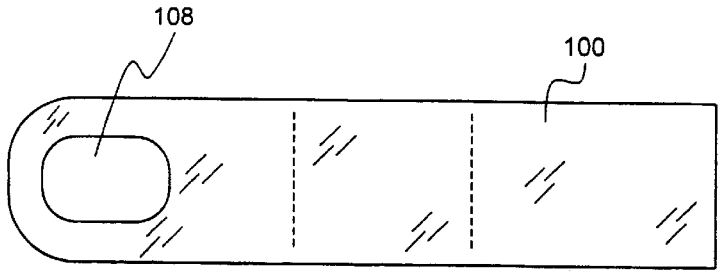
FIG. 9*b* shows the actuation element of FIG. 9*a* in top view.

In FIG. 9*a,* 9*b* and 10, an alternative embodiment for actuation element 31 is shown schematically. Instead of a pivot lever connected to an eccentric, a slider 100 is used, the beveled bottom part of which forms a running surface 102, which acts together with a pressure head 104. Different from pressure head 60 described above, pressure head 104 comprises a rounded top side 106, so that pressure head 104 acts altogether as a cam. Slider 100 being provided with a passage 108 is guided such between two guidings 110, 112, which are indicated only schematically, that it can be shifted into the direction indicated by arrow 116. In FIG. 9*a,* slider 100 is located in the clamping position, which is shown in FIG. 9*b* in top view. When slider 100 is now shifted into the direction of arrow 116 by pulling at passage 108, running surface 102 on the bottom part of slider 100 presses pressure head 104 down in direction of arrow 114. In that way, the bracing between clamping flange 28 and counter flange 26 is compensated, as was described in detail with reference to FIG. 1 to 3.

Figure 10:
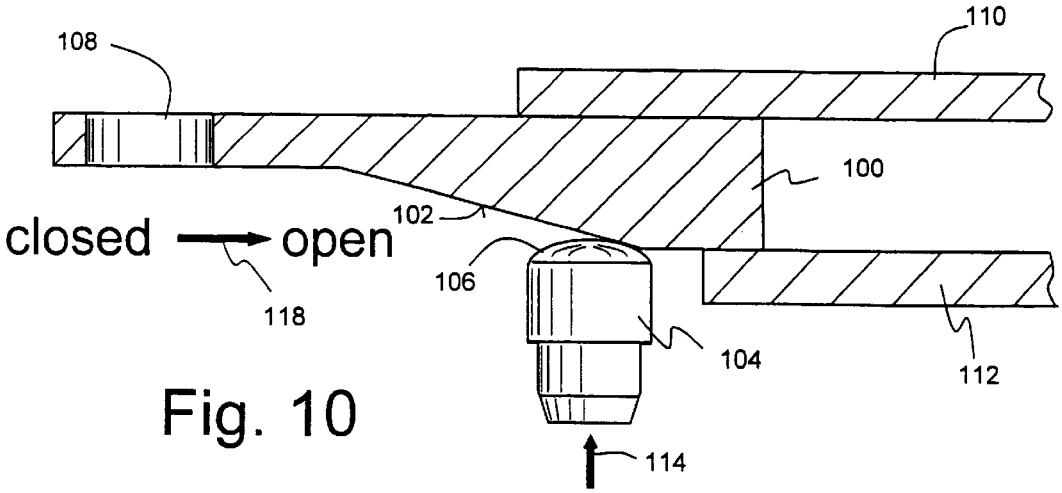
FIG. 10 shows the actuation element of FIG. 9*a* in the release position.

In FIG. 10, slider 100 is in the release position. If now pressure head 60 is set in motion, the friction force acting between top side 106 of pressure head 60 and running surface 102 of slider 100 is decreased, as already described above, whereby pressure head 60 is now able to push slider 100 back into the clamping position, as is indicated by arrow 118. Also in this case, running surface 102 can, of course, comprise different inclinations, as was described above for FIG. 7.

What is claimed is:

1. A power tool comprising a quick clamping device for fastening a tool between two flanges, said power tool comprising:

a clamping flange and a counter flange for clamping the tool therebetween;

a hollow spindle having an outer end comprising said counter flange, said clamping flange being axially displaceable with respect to said hollow spindle;

a motor for rotatingly driving said hollow spindle about a rotation axis;

a pressure head being mounted within a sleeve rotatably about said rotation axis and being arranged axially displaceable within said sleeve between a clamping position and a release position;

a cam arranged coaxially with the rotation axis on said pressure head and axially protruding therefrom;

a thrust piece arranged axially movable within said hollow spindle and comprising an inner threaded bore for threadingly engaging a threaded pin which is attached to said clamping flange;

an elastic force means arranged within said hollow spindle supported by said thrust piece for bracing said clamping flange and said counter flange against each other and for clamping the tool therebetween, when in said clamping position, wherein said pressure head, when in the release position, is rotatable together with said hollow spindle and engages the elastic force means for compensating the bracing between said counter and said clamping flanges;

an actuation element comprising a pivot lever attached to an eccentric for pivoting the latter about a pivot axis between said clamping and release positions;

a running surface being configured as a circumferential unroll surface of said eccentric, said running surface engaging said cam to effect axial displacement of said pressure head between said clamping and release positions, when pivoting, said eccentric between said clamping and release positions;

wherein a frictional force acts between said running surface and said cam impeding said pivot lever against pivoting, when being in the release position with the motor being idle;

wherein said cam and said running surface are mated to each other to effect movement of said actuation element out of the release position into the direction of the clamping position.

2. A power tool comprising a quick clamping device for fastening a tool between two flanges, said power tool comprising:

a clamping flange and a counter flange for clamping the tool therebetween;

a motor for rotatingly driving at least on of said counter and said clamping flanges;

an elastic force means for bracing said clamping flange and said counter flange against each other and for clamping the tool therebetween when being in a clamping position;

a cam being arranged axially displaceable between said clamping position and a release position, wherein said cam, when in the release position, is rotatable by said motor and engages the elastic force means for compensating the bracing between said counter and said clamping flanges;

an actuation element comprising a running surface engaging said cam and being movable between said clamping and release positions to effect axial displacement of said cam between said clamping and release positions, a frictional force acting between said running surface and said cam impeding said actuation element against movement, when being in the release position with the motor being idle;

wherein said cam and said running surface are mated to each other to effect movement of said actuation element out of the release position into the direction of the clamping position.

3. The power tool of claim 2, wherein said running surface comprises at least two sections of different inclinations.

4. The power tool of claim 3, wherein a first one of said inclinations of said running surface is smaller in the release position of said actuation element than a second one of said inclinations in the clamping position.

5. The power tool of claim 3, wherein said actuation element further comprises an eccentric being pivotable about a pivot axis, and wherein said running surface is configured as a circumferencial unroll surface of said eccentric.

6. The power tool of claim 2, wherein said running surface comprises at least two sections of different surface qualities.

7. The power tool of claim 2, wherein said actuation element comprises a pivot lever which is pivotable about a pivot axis.

8. The power tool of claim 2, wherein the surfaces of said cam and of said running surface have a Vickers hardness of more than 54, preferably about 64, and a surface roughness $R_z$ of 0,2 $\mu$m to 8 $\mu$m.

9. The power tool of claim 2, wherein said running surface of said actuation element and a surface of said cam engaged by said running consist of a porous sinter material, the pores of which near to the surface are filled with a lubricant.

10. The power tool of claim 2, further comprising a hollow spindle driven by said motor, and a thrust piece being integral with said cam, said thrust piece further comprising an attachment means for releasably attaching said clamping flange thereto, said thrust piece being arranged within said hollow spindle axially movable by pressing said actuation element against the bracing effected by said elastic force means.

11. The power tool of claim 10, wherein said cam is attached to a pressure head which is mounted rotatably and axially displaceable within a sleeve.

12. The power tool of claim 11, further comprising a spring means for bracing said pressure head against said actuation element, said pressure head coming at least indirectly into friction contact with said thrust piece, when said actuation element is moved axially against the bracing of said spring means into said release position.

13. The power tool of claim 2, further comprising an elastic return means acting onto said actuation element exerting a force thereon which supports a movement of said actuation element from said release position into the direction of said clamping position.

14. A power tool comprising a quick clamping device for fastening a tool between two flanges, said power tool comprising:

a clamping flange and a counter flange for clamping the tool therebetween;

a motor for rotatingly driving at least one of said counter and said clamping flanges;

an elastic force means for bracing said clamping flange and said counter flange against each other and for clamping the tool therebetween when being in a clamping position;

a cam being arranged axially displaceable between said clamping position and a release position, wherein said cam, when in the release position, is rotatable about a rotation axis by said motor and engages the elastic force means for compensating the bracing between said counter and said clamping flanges;

an actuation element comprising a pivot lever attached to an eccentric for pivoting the latter about a pivot axis between said clamping and release positions;

a running surface being configured as a circumferential unroll surface of said eccentric, said running surface engaging said cam to effect axial displacement of said pressure head between said clamping and release positions, when pivoting said eccentric between said clamping and release positions;

wherein a fractional force acts between said running surface and said cam impeding said actuation element against movement, when being in the release position with the motor being idle;

wherein said cam and said running surface are mated to each other to effect movement of said actuation element out of the release position into the direction of the clamping position.

15. The power tool of claim 14, wherein said eccentric has an eccentricity which is between 1% and 20% of a largest diameter of said eccentric.

16. The power tool claim 14, wherein said eccentric is arranged laterally offset from said rotation axis of said cam, into the direction in which said pivot axis of said eccentric extends.

* * * * *